US008827268B2

(12) United States Patent
Morikawa et al.

(10) Patent No.: US 8,827,268 B2
(45) Date of Patent: Sep. 9, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Shuichi Morikawa, Kahoku (JP); Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/962,775

(22) Filed: Aug. 8, 2013

(65) Prior Publication Data

US 2014/0054841 A1 Feb. 27, 2014

(30) Foreign Application Priority Data

Aug. 24, 2012 (JP) ..... 2012-185404

(51) Int. Cl.
*B65H 7/12* (2006.01)
*B65H 5/00* (2006.01)

(52) U.S. Cl.
CPC ..... *B65H 5/00* (2013.01)
USPC ..... 271/263; 271/258.01

(58) Field of Classification Search
USPC ..... 271/263, 258.01
See application file for complete search history.

(56) References Cited

U.S. PATENT DOCUMENTS 6,741,727 B1 * 5/2004 Hirasawa ..... 382/112
7,845,637 B2 12/2010 Shimazaki
8,066,280 B2 11/2011 Simonis et al.
8,091,888 B2 1/2012 Tamamoto
8,266,965 B2 9/2012 Schoen
8,419,014 B2 4/2013 Yamagishi et al.
8,567,777 B2 * 10/2013 Syracuse et al. ..... 271/263
2002/0079644 A1 6/2002 Phinney (Continued)

FOREIGN PATENT DOCUMENTS

JP 56-159656 12/1981
JP 57-169767 10/1982

(Continued)

OTHER PUBLICATIONS

Office action mailed Jul. 9, 2013 in JP 2012-185165 including English translation, 6pp.

(Continued)

*Primary Examiner* — Kaitlin Joerger
(74) *Attorney, Agent, or Firm* — Christie, Parker & Hale, LLP

(57) ABSTRACT

There are provided a paper conveying apparatus, a jam detection method and a computer-readable, non-transitory medium which can suppress erroneous detection of the occurrence of a jam. The paper conveying apparatus includes a sound signal generator, provided with a sound detector near a conveyance path of paper, for generating a sound signal corresponding to a sound generated by a paper during conveyance of the paper, a sound jam detector for determining whether a jam has occurred based on a predetermined sound signal, and a control module for performing an abnormal processing when the sound jam detector determines that the jam has occurred and the predetermined sound signal is not generated at a predetermined timing, and determining that the jam has not occurred and not performing the abnormal processing when the sound jam detector determines that the jam has occurred and the predetermined sound signal is generated at the predetermined timing.

6 Claims, 13 Drawing Sheets

(56) References Cited

U.S. PATENT DOCUMENTS

| | | | | |
|---|---|---|---|---|
| 2005/0127597 | A1 | 6/2005 | Sano et al. | |
| 2006/0145412 | A1 | 7/2006 | Tagawa et al. | |
| 2008/0224390 | A1 | 9/2008 | Ma et al. | |
| 2011/0278786 | A1* | 11/2011 | Yamagishi et al. | 271/18 |
| 2011/0292459 | A1* | 12/2011 | Murosaki | 358/442 |
| 2012/0019841 | A1* | 1/2012 | Schaertel et al. | 358/1.9 |
| 2012/0235929 | A1* | 9/2012 | Hongo et al. | 345/173 |
| 2013/0093136 | A1 | 4/2013 | Sakharshete et al. | |
| 2013/0140757 | A1 | 6/2013 | Phinney et al. | |
| 2013/0140760 | A1 | 6/2013 | Syracuse et al. | |
| 2013/0300056 | A1 | 11/2013 | Kai | |

FOREIGN PATENT DOCUMENTS

| | | |
|---|---|---|
| JP | 62-117364 | 5/1987 |
| JP | 3-192050 | 8/1991 |
| JP | 04-264462 | 9/1992 |
| JP | 5-24716 | 2/1993 |
| JP | 06-103438 | 4/1994 |
| JP | 2000-182052 | 6/2000 |
| JP | 2000-251108 | 9/2000 |
| JP | 2001-302021 | 10/2001 |
| JP | 2003-212386 | 7/2003 |
| JP | 2006-84595 | 3/2006 |
| JP | 2006-298606 | 11/2006 |
| JP | 2009-161291 | 7/2009 |
| JP | 2010-166442 | 7/2010 |
| JP | 2011-31999 | 2/2011 |
| JP | 2011-37524 | 2/2011 |
| JP | 2011-244091 | 12/2011 |
| JP | 2011-254248 | 12/2011 |
| JP | 2012-131579 | 7/2012 |

OTHER PUBLICATIONS

Office action mailed Jul. 9, 2013 in JP 2012-185247 including English translation, 6pp.

Office action mailed Sep. 24, 2013 in JP 2012-185247 including English translation, 5pp.

Office action mailed Jul. 9, 2013 in JP 2012-185335 including English translation, 6pp.

Office action mailed Jul. 9, 2013 in JP 2012-185404 including English translation, 5pp.

Office action mailed Jul. 9, 2013 in JP 2012-203446 including English translation, 6pp.

Office action mailed Jan. 7, 2014 in JP 2012-185247 including English translation, 4pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185404, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection device of a copier which converts a sound which is generated on a conveyance path to an electrical signal and determines that a jam has occurred when the time during which a reference level is exceeded exceeds a reference value has been disclosed (see Japanese Laid-Open Patent Publication No. 57-169767).

SUMMARY

For example, when a plastic card or thick paper is conveyed, that card or thick paper sometimes strikes the conveyance path of papers causing a loud sound to be generated and causing erroneous detection of a jam despite no jam has occurred.

Accordingly, it is an object of the present invention to provide a paper conveying apparatus, jam detection method which can suppress erroneous detection of the occurrence of a jam, and a computer-readable, non-transitory medium storing a computer program for causing a computer to implement such a jam detection method.

According to an aspect of the apparatus, there is provided a paper conveying apparatus. The paper conveying apparatus includes a sound signal generator, provided with a sound detector near a conveyance path of paper, for generating a sound signal corresponding to a sound generated by a paper during conveyance of the paper, a sound jam detector for determining whether a jam has occurred based on a predetermined sound signal, and a control module for performing an abnormal processing when the sound jam detector determines that the jam has occurred and the predetermined sound signal is not generated at a predetermined timing, and determining that the jam has not occurred and not performing the abnormal processing when the sound jam detector determines that the jam has occurred and the predetermined sound signal is generated at the predetermined timing.

According to an aspect of the method, there is provide a jam detection method. The jam detection method includes acquiring a sound signal corresponding to a sound generated by a paper during conveyance of the paper, determining whether a jam has occurred based on a predetermined sound signal, performing, by a computer, an abnormal processing when the computer determines that the jam has occurred and the predetermined sound signal is not generated at a predetermined timing, and determining that the jam has not occurred and not performing the abnormal processing when the computer determines that the jam has occurred and the predetermined sound signal is generated at the predetermined timing.

According to an aspect of the computer-readable, non-transitory medium storing a computer program, the computer program causes a computer to execute a process, including acquiring a sound signal corresponding to a sound generated by a paper during conveyance of the paper, determining whether a jam has occurred based on a predetermined sound signal, performing an abnormal processing when the computer determines that the jam has occurred and the predetermined sound signal is not generated at a predetermined timing, and determining that the jam has not occurred and not performing the abnormal processing when the computer determines that the jam has occurred and the predetermined sound signal is generated at the predetermined timing.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
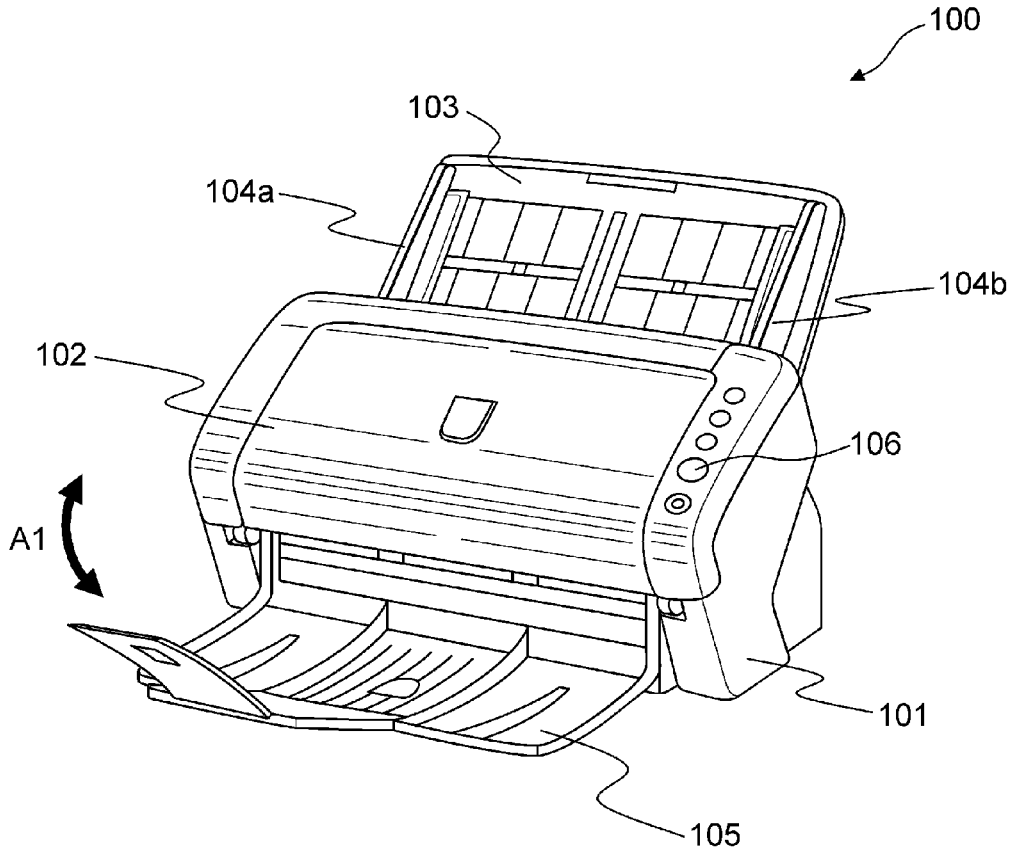
FIG. 1 is a perspective view which shows a paper conveying apparatus 100 according to an embodiment.

FIG. 1 is an example of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The lower housing 101 and the upper housing 102 are formed by plastic material. The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
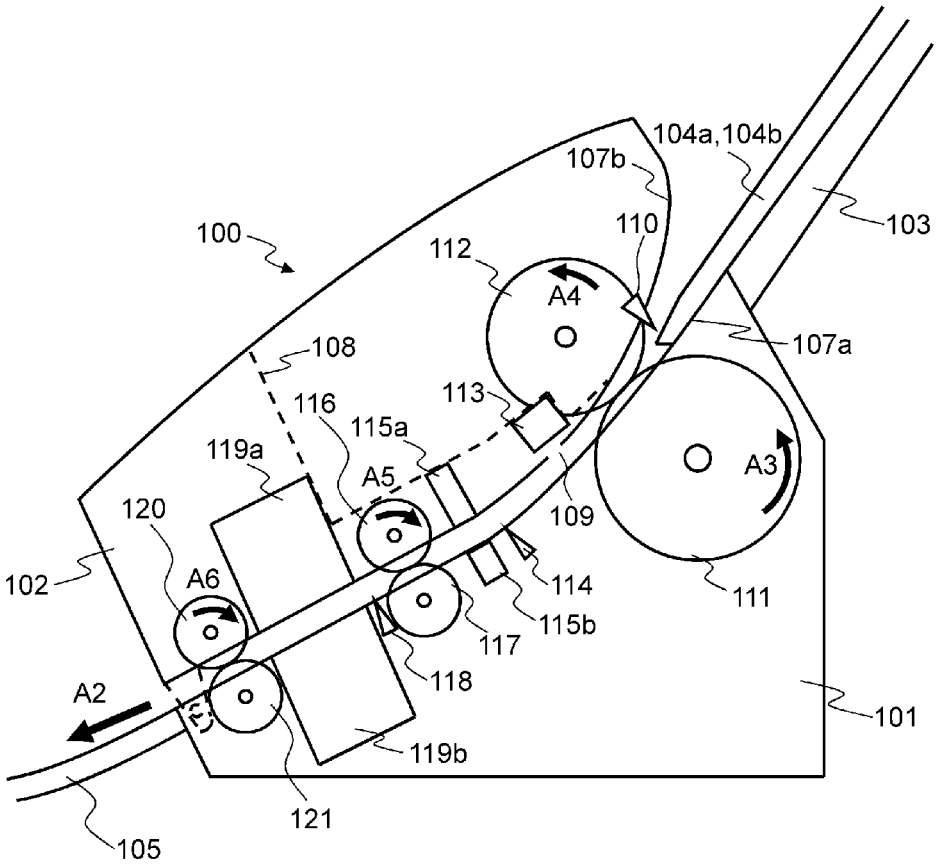
FIG. 2 is a view for explaining an example of a conveyance route at an inside of a paper conveying apparatus 100.

FIG. 2 is an example of a view for explaining the conveyance route at the inside of the paper conveying apparatus 100.

The conveyance route at the inside of the paper conveying apparatus 100 has a first paper detector 110, a paper feed roller 111, a retard roller 112, a microphone 113, a second paper detector 114, an ultrasonic transmitter 115*a*, an ultrasonic receiver 115*b*, a first conveyor roller 116, a first driven roller 117, a third paper detector 118, a first image capture unit 119*a*, a second image capture unit 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 113 is an example of a sound detector, is provided near a conveyance path of a paper, and detects the sound generated by a paper during conveyance of the paper and generates and outputs an analog signal in accordance with the detected sound. The microphone 113 is arranged at the downstream side of the paper feed roller 111 and the retard roller 112 while fastened to the frame 108 at the inside of the upper housing 102. A hole 109 is provided in the upper guide 107*b* facing the microphone 113, so that the sound generated by the paper during conveyance of the paper can be more accurately detected by the microphone 113.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there. The second paper detector 114 is an example of a position detection signal generator for detecting a position of the paper and generating a position detection signal. The second paper detection signal is an example of the position detection signal.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there. The third paper detector 114 is an example of a position detection signal generator for detecting a position of the paper and generating a position detection signal. The third paper detection signal is an example of the position detection signal.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
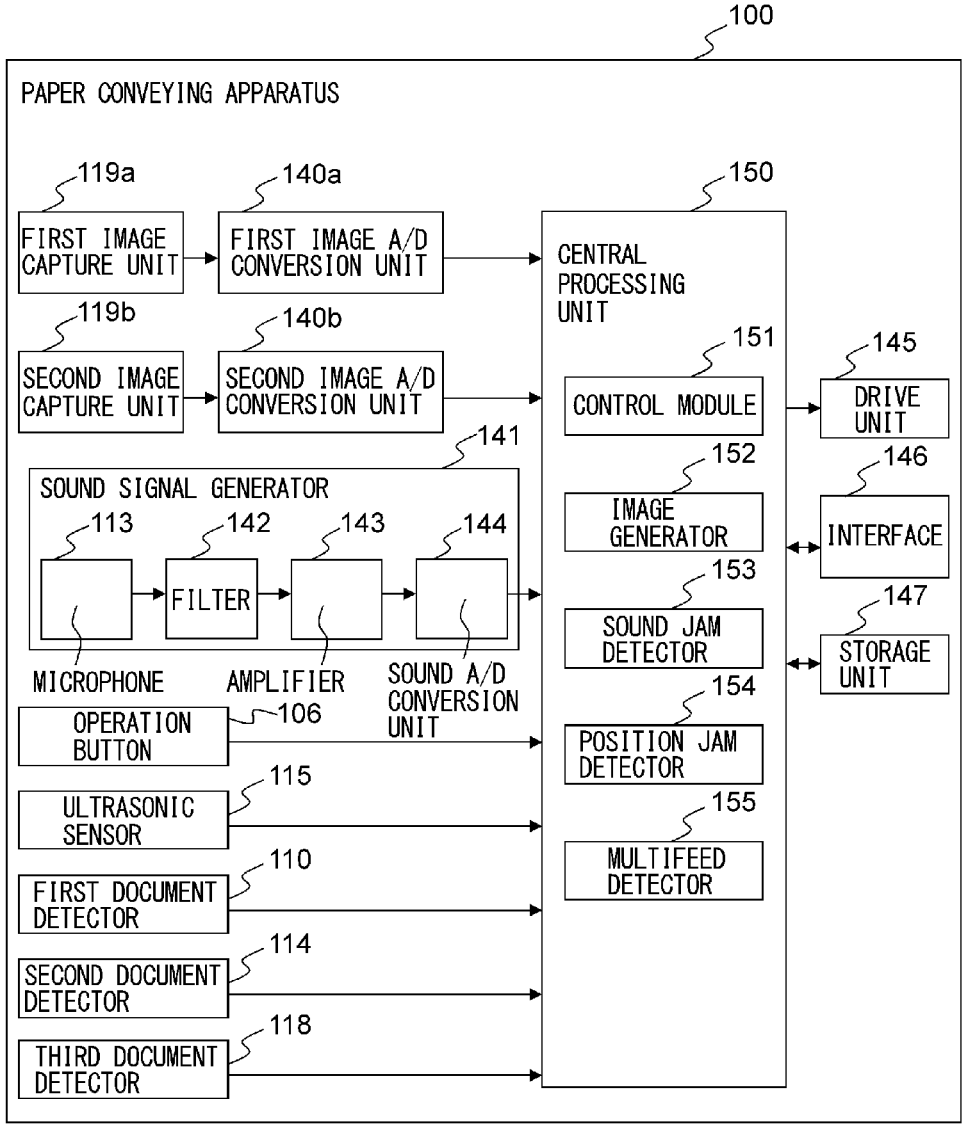
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, filter 142, amplifier 143, sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 converts the analog signal which is output from the amplifier 143 to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, the retard roller 112, the first conveyor roller 116, and the second conveyor roller 120 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, microphone 113, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, etc. These units are functional modules which are realized by software which operate on a processor. Note that, these units may be comprised of respectively independent integrated circuits, a microprocessor, firmware, etc.

Figure 4:
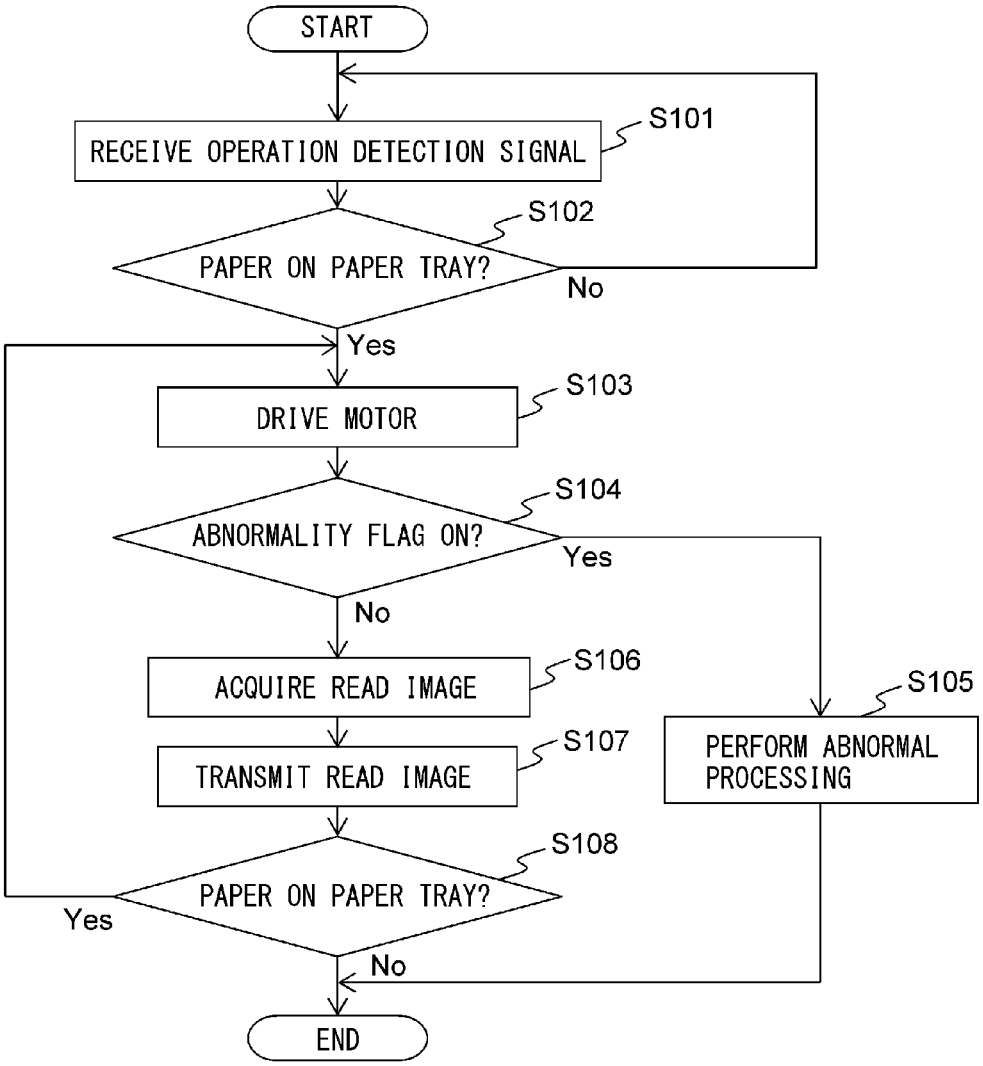
FIG. 4 is a flow chart which shows an example of operation of overall processing of the paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 120 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determines whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
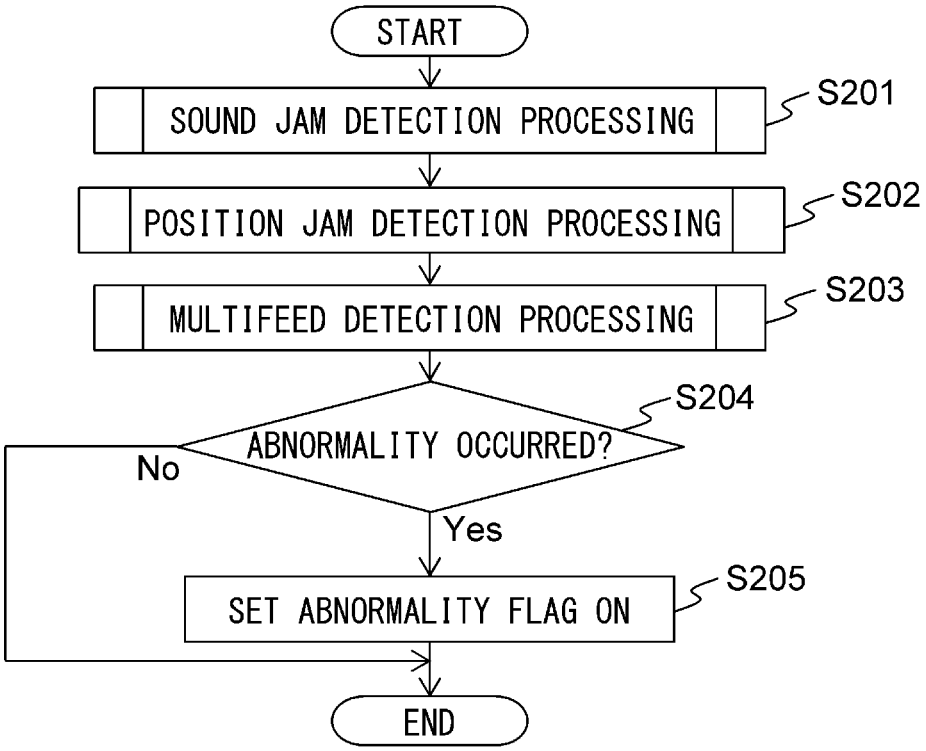
FIG. 5 is a flow chart which shows an example of an abnormality detection of the paper conveyance.

FIG. 5 is a flow chart which shows an example of an abnormality detection of the paper conveyance.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 115. Details of the multifeed detection processing will be explained later.

Next, the control module 151 determines whether an abnormality has occurred in the paper conveyance processing (step S204). Details of the abnormality detection processing will be explained later.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6A:
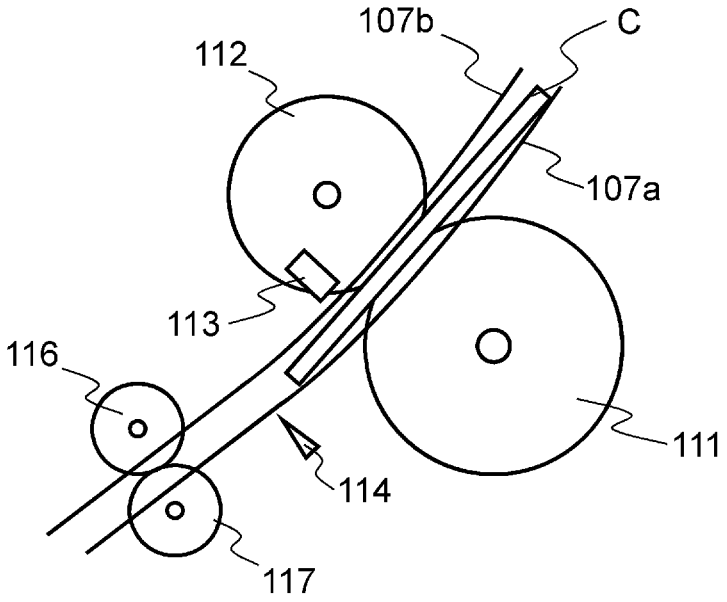
FIG. 6A is a view for explaining a case where a card is conveyed.
Figure 6B:
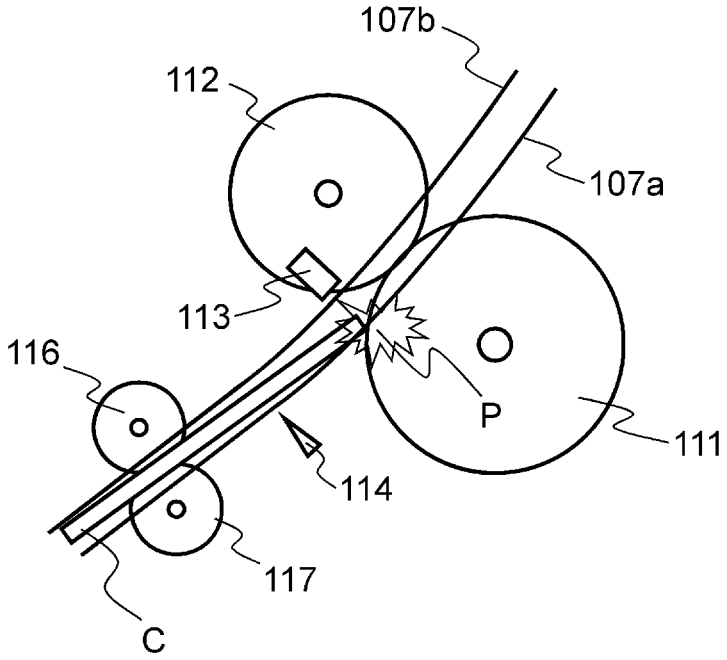
FIG. 6B is a view for explaining a case where a card is conveyed.

FIG. 6A and FIG. 6B are views for explaining the case where a card is conveyed.

FIG. 6A shows the state where a plastic or other high rigidity card C is gripped between the paper feed roller 111 and the retard roller 112. If the card C is further conveyed from the state of FIG. 6A, the state of FIG. 6A shifts to the state of FIG. 6B.

The upper guide 107*b* and the lower guide 107*a* are arranged bent, so if the card C is further gripped by the first conveyor roller 115 and the first driven roller 116 in the state gripped between the paper feed roller 111 and the retard roller 112, it deforms due to its elasticity. For this reason, as shown in FIG. 6B, when the rear end of the card C separates from the paper feed roller 111 and the retard roller 112, the card C tries to return to its original state from the deformed state, so sometimes contacts the lower guide 107*a* at the point P and impact sound is issued. The impact sound which is generated when the card C contacts the lower guide 107*a* ends up being detected by the ultrasonic receiver 114*b*.

Figure 9A:
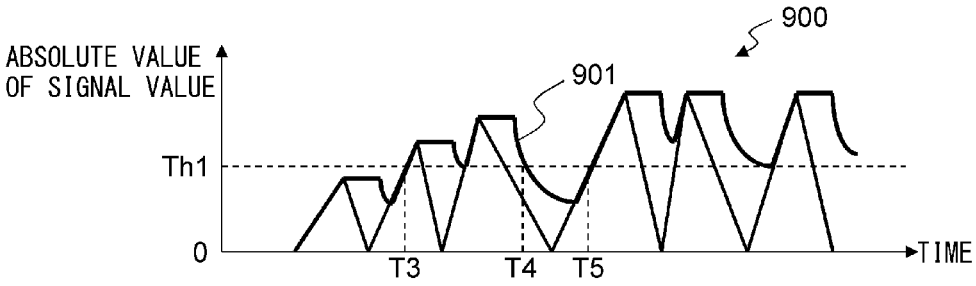
FIG. 9A is a view for explaining processing for detection of an occurrence of a jam.
Figure 9B:
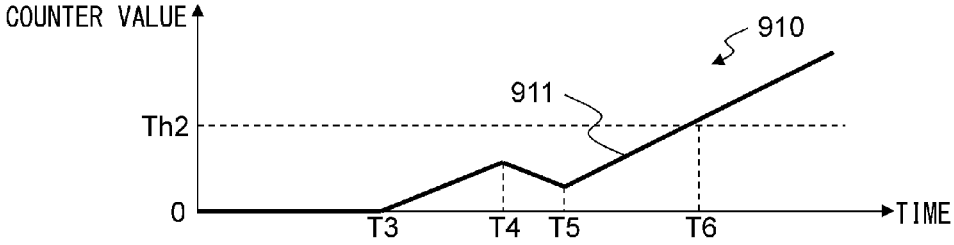
FIG. 9B is a view for explaining processing for detection of an occurrence of a jam.

The sound jam detector 153 may mistakenly determine that a jam has occurred due to the above detected impact sound. Note that, FIG. 9A and FIG. 9B show an example of a conveyance path in which an impact sound is emitted at the time of separation from the conveyor roller, but the invention is not limited to this. Further, in addition to a plastic card as well, a high rigidity thick paper may also emit an impact sound similar to a plastic card. Furthermore, even if the conveyance path is not bent, but is flat, an impact sound may be emitted due to the step difference of the rollers.

Figure 7:
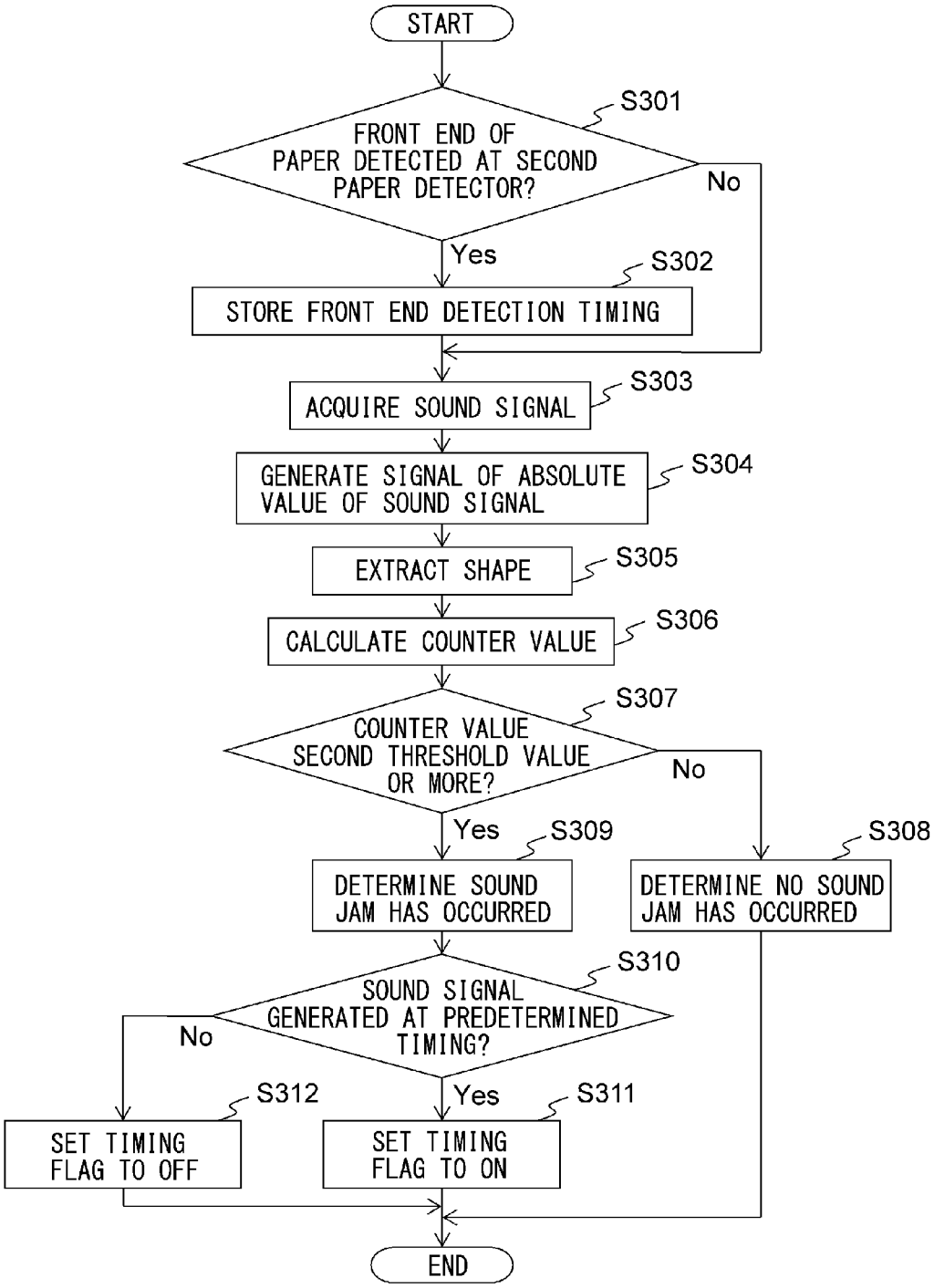
FIG. 7 is a flow chart which shows an example of operation of sound jam detection processing.

FIG. 7 is a flow chart which shows an example of operation of a sound jam detection processing.

The flow of operation which is shown in FIG. 7 is executed at step S201 of the flow chart which is shown in FIG. 5.

First, the sound jam detector 153 determines whether the second paper detector 114 has detected the front end of paper (step S301). The sound jam detector 153 determines that the front end of the paper is detected at the position of the second paper detector 114 when the value of the second paper detection signal from the second paper detector 114 changes from a value which shows the state where there is no paper to a value which shows the state where there is one.

Next, if determining that the second paper detector 114 has detected the front end of the paper, the sound jam detector 153 stores that time as a front end detection time in the storage unit 147 (step S302). On the other hand, the sound jam detector 153 does not perform any particular processing and proceeds to the processing of step S303 if it determines that the second paper detector 114 has not detected the front end of paper.

Next, the sound jam detector 153 acquires a sound signal from the sound signal generator 141 (step S303).

Figure 8A:
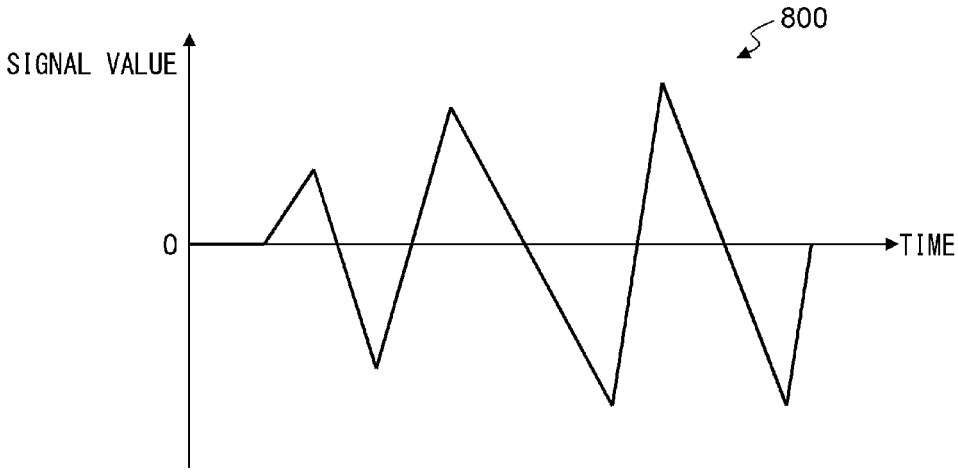
FIG. 8A is a graph which shows an example of a sound signal.

FIG. 8A is a graph which shows an example of a sound signal. The graph 800 which is shown in FIG. 8A shows a sound signal which is acquired from the sound signal generator 141. The abscissa of graph 800 shows the time, while the ordinate shows the signal value of the sound signal.

Next, the sound jam detector 153 generates a signal of the absolute value of the sound signal received from the sound signal generator 141 (step S304).

Figure 8B:
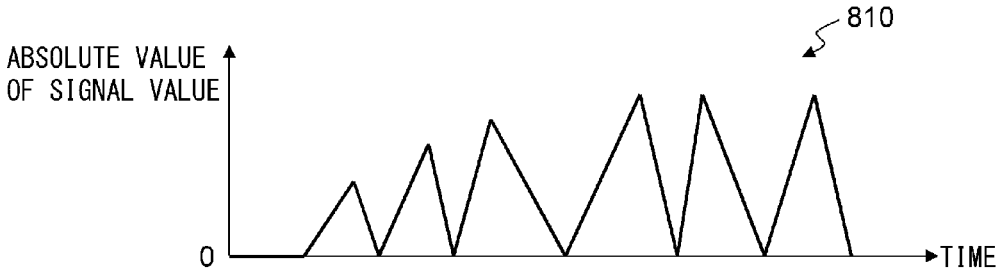
FIG. 8B is a graph which shows an example of a signal of an absolute value of a sound signal.

FIG. 8B is a graph which shows an example of the signal of the absolute value of the sound signal. The graph 810 which is shown in FIG. 8B shows the signal of the absolute value of the sound signal of the graph 800. The abscissa of graph 810 shows the time, while the ordinate shows the signal of the absolute value of the sound signal.

Next, the sound jam detector 153 extracts a shape of a signal of the absolute value of the sound signal (step S305). The sound jam detector 153 extracts the envelope as the shape of the signal of the absolute value of the sound signal.

Figure 8C:
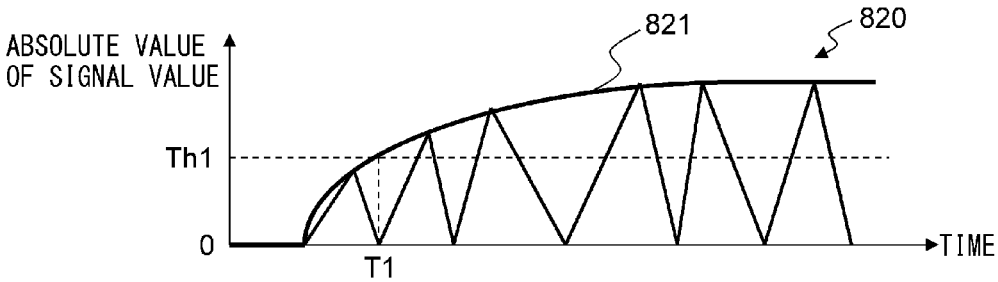
FIG. 8C is a graph which shows an example of a shape of a signal of an absolute value of the sound signal.

FIG. 8C is a graph which shows an example of the shape of a signal of the absolute value of the sound signal. The graph 820 which is shown in FIG. 8C shows the envelope 821 of the signal of the absolute value of the sound signal of the graph 810. The abscissa of the graph 820 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S306). The sound jam detector 153 determines whether the value of the envelope 821 is the first threshold value Th1 or more at each predetermined time interval (for example, sampling intervals of sound signal), increments the counter value when the value of the envelope 821 is the first threshold value Th1 or more, and decrements the counter value when it is less than the first threshold value Th1.

Figure 8D:
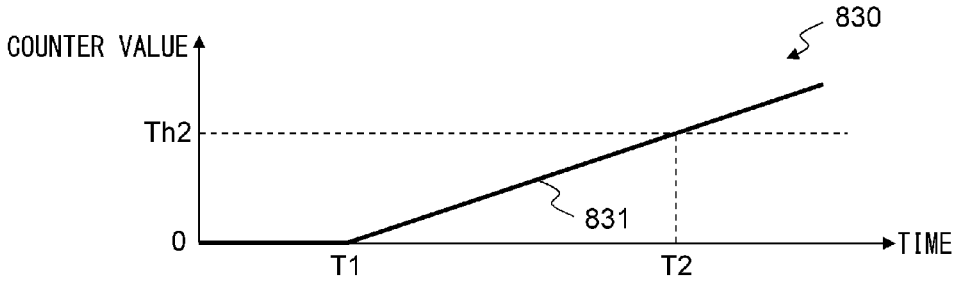
FIG. 8D is a graph which shows an example of a counter value.

FIG. 8D is a graph which shows an example of the counter value which is calculated for the shape of the signal of the absolute value of the sound signal. The graph 830 which is shown in FIG. 8D expresses the counter value which is calculated for the envelope 821 of the graph 820. The abscissa of the graph 820 shows the time, while the ordinate shows the counter value.

Next, the sound jam detector 153 determines whether the counter value is a second threshold value Th2 or more (step S307). The sound jam detector 153 determines that a sound jam has not occurred if the counter value is less than the second threshold value Th2 (step S308) and ends the series of steps. On the other hand, the sound jam detector 153 determines that a sound jam has occurred if the counter value is the second threshold value Th2 or more (step S309).

In FIG. 8C, the envelope 821 is the first threshold value Th1 or more at the time T1 and thereafter does not become less than the first threshold value Th1. For this reason, as shown in FIG. 8D, the counter value increases from the time T1 and becomes the second threshold value Th2 or more at the time T2, then the sound jam detector 153 determines that a sound jam has occurred.

Next, the sound jam detector 153 determines whether a sound signal has occurred at a predetermined timing when determining that the sound jam has occurred (step S310). The sound jam detector 153 determines that the sound signal has occurred at a predetermined timing when the time when the counter value changes from 0 to 1 is the time when a predetermined time has elapsed from the front end detection time which was stored in the storage unit 147 at step S302. This predetermined time is determined in advance and, when a card of substantially the same size as a credit card, cash card, or other card medium is conveyed, may be made the time from when the front end of the card passes the second paper detector 114 to when the back end passes between the paper feed roller 111 and the retard roller 112.

The size of credit cards, cash cards, and other card media is prescribed by the standards of the JIS (Japanese Industrial Standards) and is a long side of 85.6 cm and a short side of 54.0 cm. Cards of substantially the same size of such card media include commuter passes, telephone cards, etc. which are just slightly different in size from credit cards, cash cards, etc.

When a card medium is conveyed in the longitudinal direction, it moves for exactly the length of the length of the long side minus the distance between the nip position of the paper feed roller 111 and the retard roller 112 and the second paper detector 114 in the time from when the front end passes the second paper detector 114 to when the back end passes between the paper feed roller 111 and retard roller 112. Therefore, the predetermined time may be made a time which has a predetermined duration centered about a value acquired by subtracting from the length of a long side of the card medium the distance between the nip position of the paper feed roller 111 and the retard roller 112, and the second paper detector 114 and dividing it by the conveyance speed. Similarly, considering the case where the card medium is conveyed in the short direction, it is also possible to include in the predetermined time a time which has a predetermined duration centered about a value acquired by subtracting from the length of a short side of the card medium the distance between the nip position of the paper feed roller 111 and retard roller 112, and the second paper detector 114 and dividing it by the conveyance speed. The predetermined duration is determined considering the fact that error occurs in the timing of detection of the sound signal. For example, when the conveyance speed is 60 ppm, it can be made 100 msec.

Next, the sound jam detector 153 sets the timing flag to ON when the sound signal occurs at a predetermined timing (step S311) and sets the timing flag to OFF when it does not occur at a predetermined timing (step S312) and ends the series of steps.

Note that, at step S305, instead of acquiring an envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

FIG. 9A and FIG. 9B are views for explaining the processing for acquiring the peak hold signal from the sound signal and determining whether a sound jam has occurred.

The graph 900 which is shown in FIG. 9A expresses the peak hold signal 901 for the signal of the absolute value of the sound signal of the graph 810. The abscissa of the graph 900 shows the time, while the ordinate shows the absolute value of the signal value of the sound signal.

The graph 910 which is shown in FIG. 9B shows the counter value which was calculated for the peak hold signal 901 of the graph 900. The abscissa of the graph 910 shows the time, while the ordinate shows the counter value. The peak hold signal 901 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 9B, the counter value increases from the time T3, decreases from the time T4, again increases from the time T5, and becomes the second threshold value Th2 or more at the time T6, so it is determined that a sound jam has occurred.

Note that, at step S310, the sound jam detector 153 may determine that the sound signal has occurred at the predetermined timing, not when the time when the counter value changes from 0 to 1 is the time when a predetermined time has elapsed from the front end detection time, but when the time in the period from when the counter value changes from 0 to 1 to when it becomes the second threshold value Th2 or more overlaps the time when the predetermined time has elapsed from the front end detection time.

Further, the sound jam detector 153 may determine that a sound signal has occurred at a predetermined timing when the time at which the counter value changes from 0 to 1 is the time after the elapse of a predetermined time from when the central processing unit 150 drives the drive unit 145 to start the rotation of the paper feed roller 111 and retard roller 112. In this case, at the time when it starts rotation of the paper feed roller 111 and retard roller 112, the front end of the card medium is positioned at the nip position, so the predetermined time can be made a time which has predetermined durations centered about respectively the value acquired by dividing a length of a long side of the card medium by the conveyance speed and the value acquired by dividing a length of a short side by the conveyance speed.

Alternatively, the sound jam detector 153 may determine that a sound signal has occurred at a predetermined timing when the time when the counter value changes from 0 to 1 for the second and subsequent sheet of paper in the case where a plurality of sheets of paper are conveyed is a time after the elapse of a predetermined time from when the back end of the paper conveyed immediately before was detected by the second paper detector 114.

Further, the sound jam detector 153 may determine the timing at which the sound signal has occurred based on the third paper detection signal from the third paper detector 118 instead of the second paper detection signal from the second paper detector 114.

Alternatively, the sound jam detector 153 may determine the timing at which the sound signal has occurred based on an ultrasonic signal from the ultrasonic sensor 115. In this case, the sound jam detector 153 periodically acquires an ultrasonic signal from the ultrasonic sensor 115 and determines that the front end of paper has passed the ultrasonic sensor 115 when the signal value of the acquired ultrasonic signal changes from a predetermined threshold value or more to less than the predetermined threshold value. Further, the sound jam detector 153 determines that the sound signal has occurred at a predetermined timing when the time when the counter value changes from 0 to 1 is a time after the elapse of a predetermined time from when the front end of the paper passed the ultrasonic sensor 115.

Figure 10:
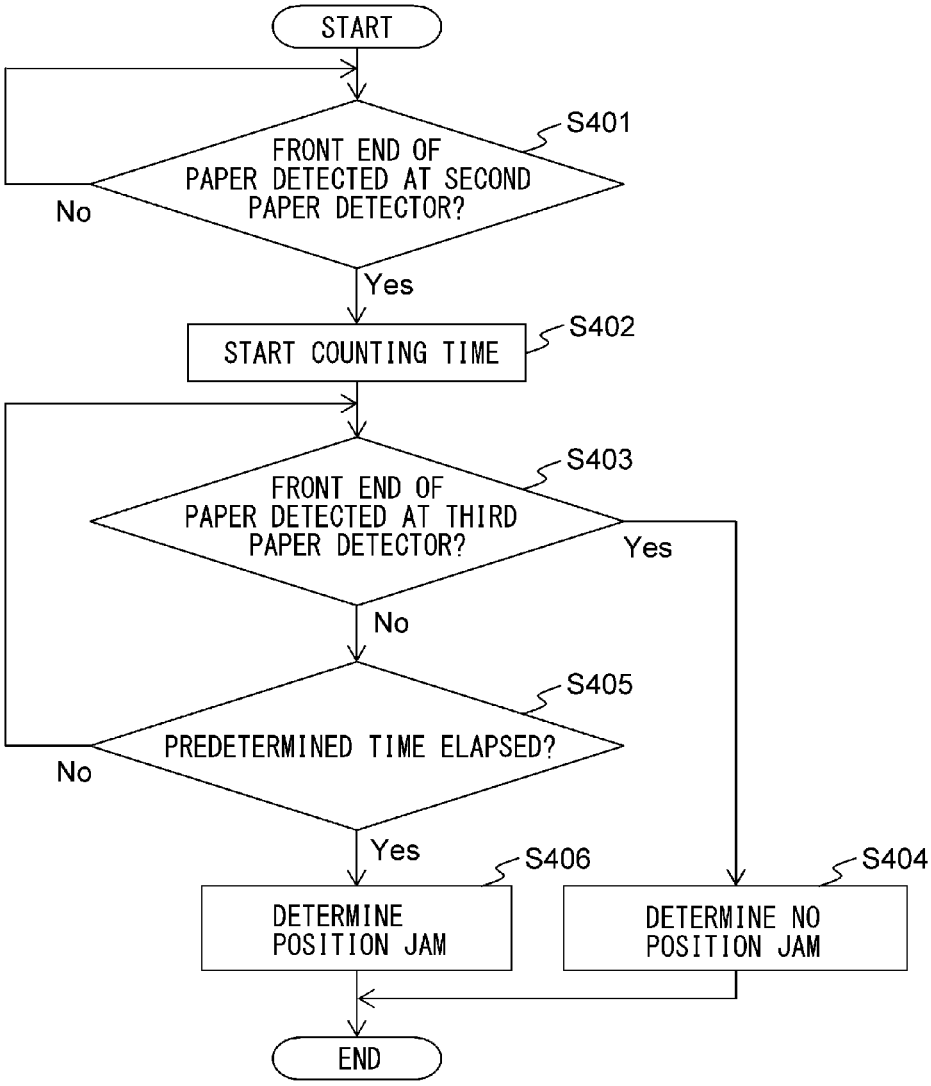
FIG. 10 is a flow chart which shows an example of operation of position jam detection processing.

FIG. 10 is a flow chart which shows an example of operation of a position jam detection processing.

The flow of operation which is shown in FIG. 10 is executed at step S202 of the flow chart which is shown in FIG. 5.

First, the position jam detector 154 stands by until the front end of the paper is detected by the second paper detector 114 (step S401). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S402).

Next, the position jam detector 154 determines whether the third paper detector 118 has detected the front end of the paper (step S403). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S404) and ends the series of steps.

On the other hand, if the third paper detector 118 detects the front end of the paper, the position jam detector 154 determines whether a predetermined time (for example, 1 second) has elapsed from the start of counting time (step S405). If a predetermined time has not elapsed, the position jam detector 154 returns to the processing of step S403 and again determines whether the third paper detector 118 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 11:
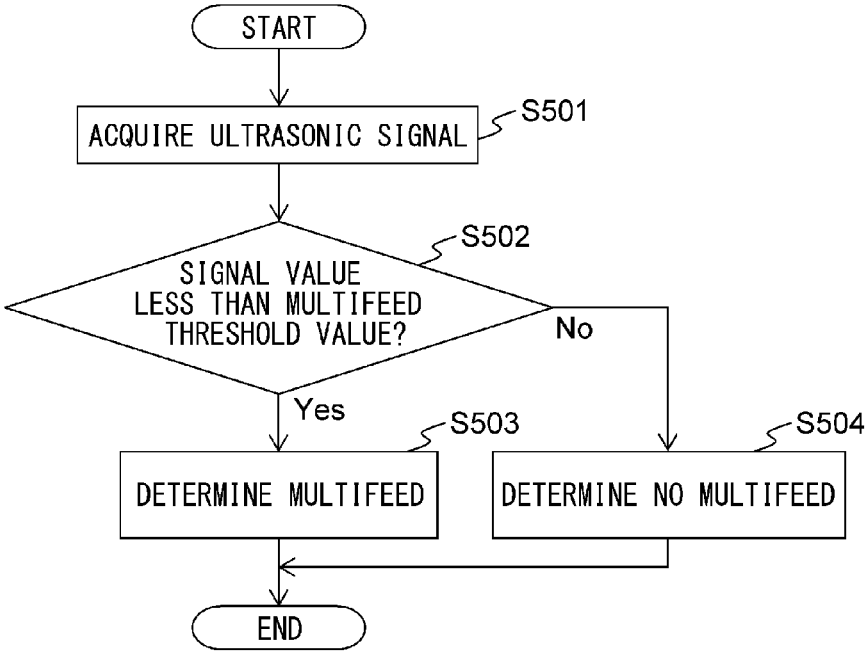
FIG. 11 is a flow chart which shows an example of operation of multifeed detection processing.

FIG. 11 is a flow chart which shows an example of operation of multifeed detection processing.

The flow of operation which is shown in FIG. 11 is executed at step S203 of the flow chart which is shown in FIG. 5.

First, the multifeed detector 155 acquires an ultrasonic signal from the ultrasonic sensor 115 (step S501).

Next, the multifeed detector 155 determines whether the signal value of the acquired ultrasonic signal is less than the multifeed detection threshold value (step S502).

Figure 12:
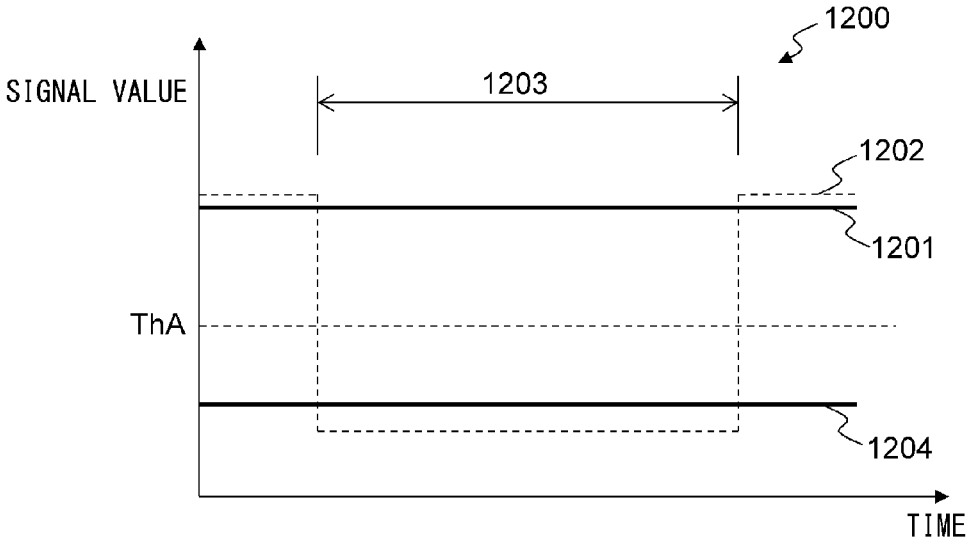
FIG. 12 is a view for explaining properties of an ultrasonic signal.

FIG. 12 is a view for explaining properties of an ultrasonic signal.

In the graph 1200 of FIG. 12, the solid line 1201 shows the characteristic of the ultrasonic signal in the case where a single paper is conveyed, while the broken line 1202 shows the characteristic of the ultrasonic signal in the case where multifeed of papers has occurred. The abscissa of the graph 1200 shows the time, while the ordinate shows the signal value of the ultrasonic signal. Due to the occurrence of multifeed, the signal value of the ultrasonic signal of the broken line 1202 falls in the section 1203. For this reason, it is possible to determine whether multifeed of papers has occurred by whether the signal value of the ultrasonic signal is less than the multifeed detection threshold value ThA.

On the other hand, the multifeed solid line 1204 shows the characteristic of the ultrasonic signal in the case where just one plastic card thicker than paper is conveyed. When a card is conveyed, the signal value of the ultrasonic signal becomes smaller than the multifeed detection threshold value ThA, so the multifeed detector 155 mistakenly determines that a multifeed of papers has occurred. Note that, even if sufficiently thick, high rigidity thick paper has been conveyed, an ultrasonic signal which has characteristics similar to the case where a plastic card is conveyed is detected, so the multifeed detector 155 is liable to mistakenly determine that a multifeed of papers has occurred.

The multifeed detector 155 determines that multifeed of the papers has occurred when the signal value of the ultrasonic signal is less than the multifeed detection threshold value (step S503), determines that multifeed of the papers has not occurred when the signal value of the ultrasonic signal is the multifeed detection threshold value or more (step S504), and ends the series of steps.

Figure 13:
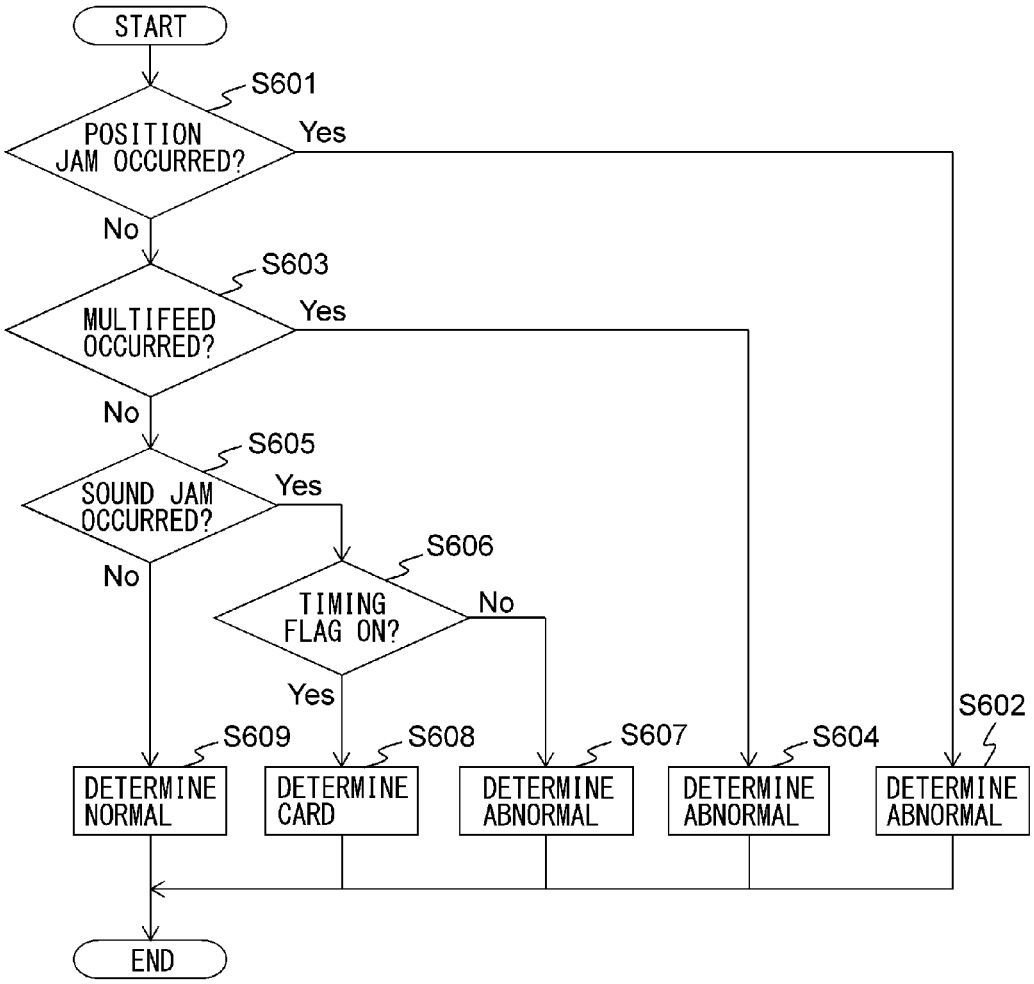
FIG. 13 is a flow chart which shows an example of operation of an abnormality detection processing.

FIG. 13 is a flow chart which shows an example of operation of abnormality detection processing.

The flow of operation which is shown in FIG. 13 is performed at step S204 of the flow chart which is shown in FIG. 5.

First, the control module 151 determines whether the position jam detector 154 has determined that a position jam has occurred (step S601). When the position jam detector 154 has determined that a position jam has occurred, the control module 151 determines that a jam has occurred and an abnormality has occurred (step S602) and ends the series of steps.

When the position jam detector 154 has not determined that a position jam has occurred, the control module 151 determines whether the multifeed detector 155 has determined that a multifeed has occurred (step S603). If the multifeed detector 155 determines a multifeed has occurred, the control module 151 determines that a multifeed of papers has occurred and an abnormality has occurred (step S604) and ends the series of steps.

If the multifeed detector 155 has not determined that a multifeed has occurred, the control module 151 determines whether the sound jam detector 153 determines that a sound jam has occurred (step S605).

When the sound jam detector 153 determines that a sound jam has occurred, the control module 151 determines whether a timing flag is set to ON (step S606). If the timing flag has not been set to ON, the control module 151 determines that a jam has occurred and that an abnormality has occurred (step S607) and ends the series of steps.

On the other hand, if the timing flag has been set to ON, the control module 151 determines that the sound jam detector 153 has determined that a sound jam has occurred due to a card or thick paper having been conveyed. In this case, the control module 151 deems that that a jam has not occurred and determines the state is normal (step S609) and ends the series of steps.

Further, when, at step S605, the sound jam detector 153 has not determined that a sound jam has occurred, the control module 151 determines that a jam has not occurred and that the state is normal (step S609) and ends the series of steps.

As explained above in detail, even when the paper conveying apparatus 100 operates in accordance with the flow chart which is shown in FIG. 4, FIG. 5, FIG. 7, FIG. 11 and FIG. 13 and determines that a jam has occurred based on the sound which the paper generates during conveyance, it deems that a card or thick paper has been conveyed when that sound has occurred at a predetermined timing, so can suppress erroneous detection of the occurrence of a jam when card or thick paper has been conveyed.

Figure 14:
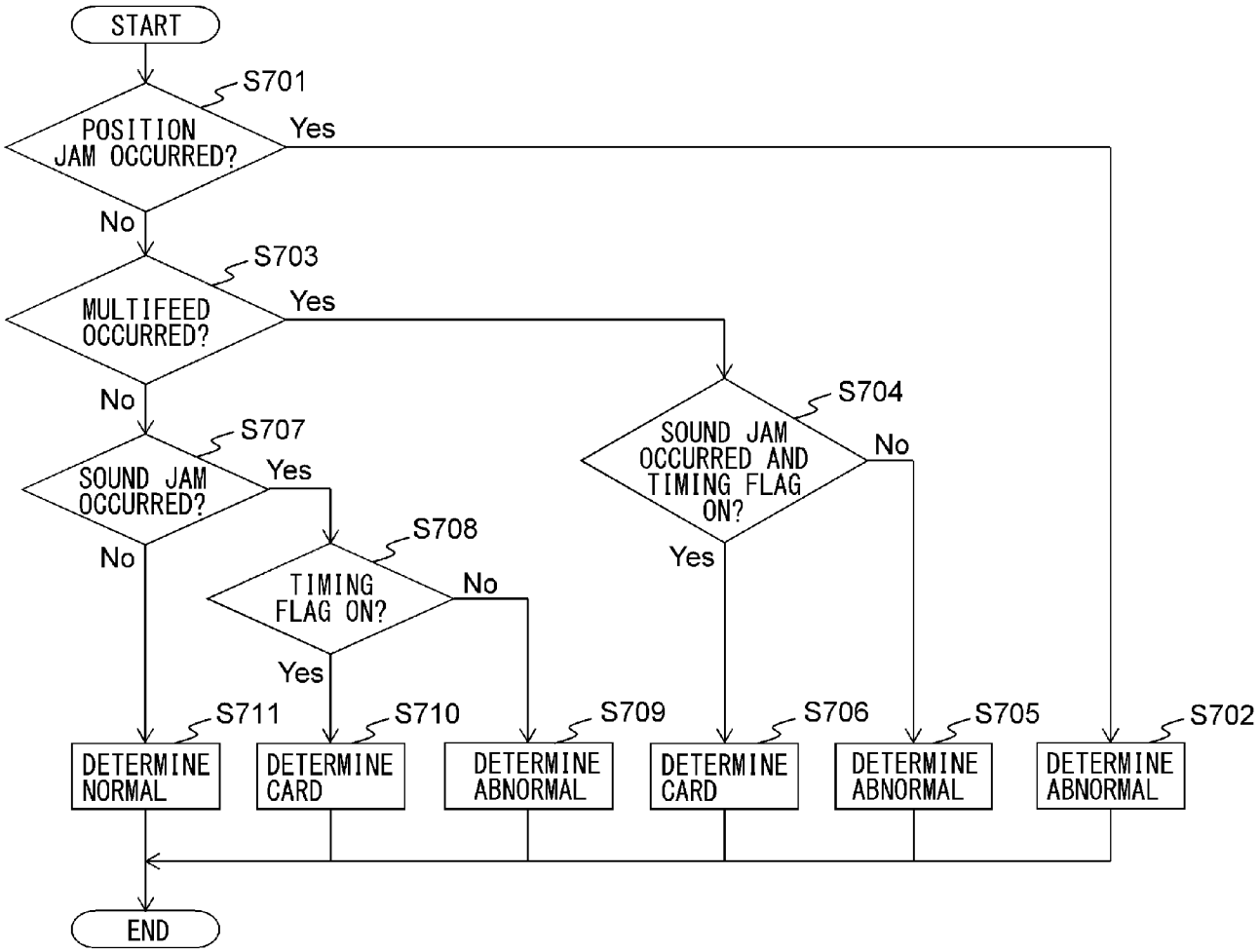
FIG. 14 is a flow chart which shows another example of operation of an abnormality detection processing.

FIG. 14 is a flow chart which shows another example of the operation of abnormality detection processing.

This flow chart can be followed in the paper conveying apparatus 100 instead of the flow chart shown in the above-mentioned FIG. 13. In the flow chart which is shown in FIG. 14, unlike the flow chart which is shown in FIG. 13, the control module 151 deems that a card or thick paper has been conveyed when a sound occurs at a predetermined timing even when the multifeed detector 155 determines that multifeed has occurred. The processing of steps S701 to S703 and S707 to S711 which are shown in FIG. 14 is the same as the processing of steps S601 to S603 and S605 to S609 which are shown in FIG. 13, so the explanations will be omitted. Below, only the processing of steps S704 to S706 will be explained.

When, at step S703, the multifeed detector 155 determines that a multifeed has occurred, the control module 151 determines whether the sound jam detector 153 has determined the occurrence of a sound jam and whether the timing flag is set to ON (step S704).

When the sound jam detector 153 has not determined the occurrence of a sound jam or when the timing flag has not been set to ON, the control module 151 determines that a multifeed of papers has occurred and an abnormality has occurred (step S705) and ends the series of steps.

On the other hand, when the sound jam detector 153 has determined the occurrence of a sound jam and when the timing flag has been set to ON, the control module 151 determines that a card or thick paper has been conveyed and therefore the multifeed detector 155 has determined the occurrence of multifeed. In this case, the control module 151 deems that multifeed of papers has not occurred, determines the state to be normal (step S706), and ends the series of steps.

As explained above in detail, even when the paper conveying apparatus 100 operates in accordance with the flow chart which is shown in FIG. 4, FIG. 5, FIG. 7, FIG. 11, and FIG. 14 and determines that a multifeed has occurred based on the ultrasonic signal, it deems that a card or thick paper has been conveyed when a predetermined sound has occurred at a predetermined timing. Therefore, the paper conveying apparatus 100 can suppress erroneous detection of the occurrence of a multifeed in the case where a card or thick paper has been conveyed.

According to the paper conveying apparatus and the jam detection method, and the computer-readable, non-transitory medium, even when it is determined that a jam has occurred based on the sound generated by paper during conveyance, if that sound is generated at a predetermined timing, it is deemed that a card or thick paper has been conveyed, so it becomes possible to suppress erroneous detection of an occurrence of a jam.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a separator;

a sound signal generator, provided with a sound detector near a conveyance path of paper, for generating a sound signal corresponding to a sound generated by a paper during conveyance of the paper;

a sound jam detector for determining whether a jam has occurred based on a predetermined sound signal; and a control module for performing an abnormal processing based on the jam detection by the sound jam detector, wherein the control module determines that the jam has not occurred and does not perform the abnormal processing when the sound jam detector determines that the jam has occurred and the predetermined sound signal is generated at a time at which a back end of a card or a thick paper, detected by the sound jam detector, passes the separator when conveyed paper is the card or the thick paper.

2. The paper conveying apparatus according to claim 1, further comprising:

an ultrasonic detector, provided near the conveyance path of a paper, for detecting an ultrasonic wave which passes through the paper and outputting an ultrasonic signal; and a multifeed detector for determining whether a multifeed of papers has occurred based on the ultrasonic signal, wherein the control module does not perform the abnormal processing when the multifeed detector determined that a multifeed has occurred and the predetermined sound signal is generated at the time at which the back end of the card or the thick paper passes the separator.

3. The paper conveying apparatus according to claim 1, further comprising a position detection signal generator for detecting a position of the paper and generating a position detection signal, wherein the control module determines the time at which the back end of the card or the thick paper passes the separator based on the position detection signal.

4. The paper conveying apparatus according to claim 1, further comprising a separator, wherein the control module sets the time at which the back end of the card or the thick paper passes the separator to a time at which a back end of a second card of approximately the same size as the card passes the separator when the second card is conveyed.

5. A jam detection method comprising:

acquiring a sound signal from a sound signal generator, provided with a sound detector near a conveyance path of paper, corresponding to a sound generated by a paper during conveyance of the paper;

determining whether a jam has occurred based on a predetermined sound signal; and performing, by a computer, an abnormal processing based on the jam detection by the sound jam detector, wherein the computer determines that the jam has not occurred and does not perform the abnormal processing when determining that the jam has occurred and the predetermined sound signal is generated at a time at which a back end of a card or a thick paper, detected by a sound jam detector, passes the separator when conveyed paper is the card or the thick paper in the performing step.

6. A computer-readable, non-transitory medium storing a computer program, wherein the computer program causes a computer to execute a process, the process comprising:

acquiring a sound signal from a sound signal generator, provided with a sound detector near a conveyance path of paper, for generating the sound signal corresponding to a sound generated by a paper during conveyance of the paper;

determining whether a jam has occurred based on a predetermined sound signal; and performing an abnormal processing based on the jam detection by the sound jam detector, wherein the computer determines that the jam has not occurred and does not perform the abnormal processing when determining that the jam has occurred in the determining step and the predetermined sound signal is generated at a time at which a back end of a card or a thick paper, detected by a jam sound detector, passes the separator when conveyed paper is the card or the thick paper in the performing step.

* * * * *